US007429160B2

(12) United States Patent
Roudnev et al.

(10) Patent No.: US 7,429,160 B2
(45) Date of Patent: Sep. 30, 2008

(54) FLEXIBLE FLOATING RING SEAL ARRANGEMENT FOR ROTODYNAMIC PUMPS

(75) Inventors: Aleksander S. Roudnev, De Forest, WI (US); Randy J. Kosmicki, Edgerton, WI (US)

(73) Assignee: Weir Slurry Group, Inc., Madison, WI (US)

( * ) Notice: Subject to any disclaimer, the term of this patent is extended or adjusted under 35 U.S.C. 154(b) by 109 days.

(21) Appl. No.: 11/329,024

(22) Filed: Jan. 10, 2006

(65) Prior Publication Data

US 2007/0160465 A1 Jul. 12, 2007

(51) Int. Cl.
*F04D 29/08* (2006.01)

(52) U.S. Cl. ..... 415/174.3; 416/174

(58) Field of Classification Search ..... 415/174.3; 416/174

See application file for complete search history.

(56) References Cited

U.S. PATENT DOCUMENTS

| | | | | |
|---|---|---|---|---|
| 2,013,499 | A | | 9/1935 | Meckenstock |
| 2,270,054 | A | * | 1/1942 | Hogan ..... 415/174.3 |
| 2,396,319 | A | * | 3/1946 | Edwards et al. ..... 415/170.1 |
| 2,736,265 | A | | 2/1956 | Higgins |
| 3,516,757 | A | | 6/1970 | Baumann |
| 3,881,840 | A | | 5/1975 | Bunjes |
| 4,909,707 | A | | 3/1990 | Wauligman et al. |
| 4,976,444 | A | | 12/1990 | Richards |
| 5,302,089 | A | | 4/1994 | Maruyama et al. |
| 5,518,256 | A | | 5/1996 | Gaffal |
| 5,971,704 | A | | 10/1999 | Blattmann |
| 5,984,629 | A | | 11/1999 | Brodersen et al. |
| 6,082,964 | A | | 7/2000 | Kuroiwa |
| 6,739,829 | B2 | | 5/2004 | Addie |
| 2004/0136825 | A1 | | 7/2004 | Addie et al. |
| 2005/0191175 | A1 | | 9/2005 | Geldenhuys |

* cited by examiner

*Primary Examiner*—Richard Edgar
(74) *Attorney, Agent, or Firm*—Morriss O'Bryant Compagni

(57) ABSTRACT

A floating ring seal arrangement for rotodynamic pumps comprises a flexible ring that is structured to fit within a circular channel formed by generally concentric grooves in the rotating and non-rotating elements of the pump, the ring further being sized to rest against the inner diameter of the groove of the rotating element when static, and capable of radially expansion under centrifugal forces to cause the flexible ring to float in the circular channel during operation of the pump, or deformation under centrifugal or pressure forces such that gaps between the flexible ring and groove in the non-rotating element are minimized or eliminated.

17 Claims, 3 Drawing Sheets

FLEXIBLE FLOATING RING SEAL ARRANGEMENT FOR ROTODYNAMIC PUMPS

BACKGROUND OF THE INVENTION

1. Field of the Invention

This invention relates to rotodynamic pumps, and specifically relates to means for restricting fluid recirculation and for reducing wear between rotating and non-rotating elements of rotodynamic pumps, particularly those pumps suitable for handling slurries.

2. Description of Related Art

Rotodynamic pumps, such as centrifugal pumps, are commonly known and used for pumping fluids in many types of industries and for many applications. Such pumps generally comprise an impeller (rotating element) housed within a pump casing (non-rotating element) having a fluid inlet and fluid outlet, or discharge. The impeller is typically driven by a motor external to the casing. The impeller is positioned within the casing so that fluid entering the inlet of the casing is delivered to the center, or eye, of the impeller. Rotation of the impeller acts on the fluid primarily by the action of the impeller vanes which, combined with centrifugal force, move the fluid to the peripheral regions of the casing for discharge from the outlet.

The dynamic action of the vanes, combined with centrifugal forces resulting from impeller rotation, produce pressure gradients within the pump. An area of lower pressure is created nearer the eye of the impeller and an area of higher pressure results at the outer diameter of the impeller and in the volute portion of the casing. An area of pressure change from higher to lower exists in the radially extending gap between the rotating and non-rotating components. The pressure differential within the pump leads to fluid recirculation through the radial gap, between areas of high and low pressure. Such fluid recirculation, typically characterized as leakage, results in a consequent loss of pump performance and, in the presence of solid particles, a dramatic increase in wear. Therefore, pumps are structured with various sealing devices, both on the shaft side of the impeller to prevent external leakage and on the suction side of the impeller to prevent internal recirculating leakage.

Effective sealing arrangements are known and employed in pumps that process clear liquid. For example, U.S. Pat. No. 4,909,707 to Wauligman, et al., describes a floating casing ring that is positioned in the axially-extending radial gap between the impeller and the pump casing. Similar floating seal rings are described in U.S. Pat. No. 4,976,444 to Richards and U.S. Pat. No. 5,518,256 to Gaffal. U.S. Pat. No. 6,082,964 to Kuroiwa discloses a supported annular ring that is thereby allowed to float in surrounding fluid. Such sealing systems are directed to preventing leakage at the axially-extending radial gap between the rotating and non-rotating elements. These sealing arrangements may also include a wear ring element. One purpose of the wear ring is to reduce wear caused by contacting of the rigid components of the seal.

When pumps are used to process slurries, the abrasive particulate matter in the slurry causes wearing between rotating and non-rotating (i.e., stationary) elements of the pump. The wear dramatically increases when fluid recirculation occurs as previously described. Thus, an effective sealing means between rotating and stationary pump elements is desirable in order to effectively reduce fluid recirculation between the rotating and stationary elements of slurry pumps, and thereby effectively reduce wear.

Various examples of sealing arrangements for slurry pumps have been previously disclosed. Some sealing and/or wear ring arrangements have been disclosed for positioning in an essentially axially-extending radial gap between the impeller and the pump casing. Such sealing arrangements are disclosed in U.S. Pat. No. 3,881,840 to Bunjes and U.S. Pat. No. 5,984,629 to Brodersen, et al., both of which describe a fixed ring formed in the pump casing which interacts with a projecting element on the impeller to provide a labyrinthine seal and/or wear ring. It has to be noted that in general, axially-extending radial gaps are not well-suited for handling slurries due to high probability of solid particle entrapment between the rotating and non-rotating elements causing rapid wear in the pump elements.

Radially-extending axial gaps, or tapered gaps which are substantially radially-extending, are much less prone to entrapment of solids. Such sealing and leakage restricting arrangements are widely used in slurry pumps. U.S. Pat. Ser. No. 2004/0136825 to Addie, et al. discloses a fixed projection on either the pump casing or on the impeller to provide a leakage restricting arrangement between the impeller and the pump casing.

U.S. Pat. No. 6,739,829 to Addie discloses a floating ring element positioned between the impeller and pump casing which is also configured with means for receiving and distributing cooling and flushing fluid into the gap between the impeller and pump casing. Like other sealing arrangements, the floating ring seal of the '829 patent is purposefully sized and configured to provide a gap between the impeller and the sealing device to prevent friction between the seal and the impeller, and thereby prevent galling of the seal during rotation of the impeller. A necessary component of this design, therefore, is the presence of a flush system.

Prior sealing arrangements have heretofore been specifically directed to providing a seal that has sufficient clearance such that it does not contact the rotating elements of the pump, specifically to reduce or prevent wear and galling in the seal. As a result, such seal arrangements may still be vulnerable to undesirable fluid recirculation and wear between rotating and stationary elements of the pump. Moreover, placement of a sealing arrangement near the eye of the impeller in an axially-extending gap between the casing and impeller does not present the most effective means of preventing solid particle entrapment and subsequent wear between the casing and impeller.

Thus, it would be advantageous in the art to provide a relatively simple sealing arrangement which does not rely on a flush system and that effectively provides resistance to recirculation and wear between rotating and non-rotating elements of the pump, and one which is ideally located within the pump at a position where resistance to recirculation and wear can be most effective.

BRIEF SUMMARY OF THE INVENTION

In accordance with the present invention, a flexible floating seal ring arrangement is provided for restricting fluid recirculation and limiting wear between rotating and non-rotating elements of rotodynamic pumps, and is configured for effectively bridging the radially-extending gap between such rotating and non-rotating elements in a manner that provides more effective resistance to fluid recirculation and wear. The flexible floating seal ring arrangement is described herein with respect to use in a centrifugal pump of the slurry type primarily to reduce wear, but may be adapted for use in any rotodynamic pump with a resulting increase in pump performance.

The flexible floating seal ring arrangement of the present invention generally comprises a ring made of flexible material which renders the ring radially deformable under the influence of centrifugal forces when rotating. The ring is structured to fit within a circular channel comprising a circular groove formed in a substantially radially extending surface of the non-rotating pump casing and a circular groove formed in a substantially radially extending surface of the rotating impeller. The flexible ring is sized in axial length to fit within the circular channel and axially span the radially-extending axial gap between the pump casing and the impeller.

The flexible ring is particularly sized with an inner diameter which, when positioned on the inner diameter of the groove formed in the impeller when the impeller is static (i.e., not rotating), provides a snug fit of the flexible ring on the inner diameter of the impeller groove. Consequently, the inner diameter of the flexible ring is slightly smaller than the inner diameter of the impeller groove so that when the flexible ring in installed in the groove of the impeller at assembly, the flexible ring must be slightly stretched to fit snugly onto the inner diameter of the impeller groove and not wobble when the impeller is static.

Upon rotation of the impeller, the flexible ring deforms radially under centrifugal forces, thereby minimizing the gaps between the flexible ring and the outer diameter of the grooves in the rotating and non-rotating elements. Depending on the speed of rotation of the impeller, the flexible ring may, from time to time, contact the outer diameter of the circular channel in the stationary casing wall. Further depending on the speed of rotation, the flexible ring may rotate at a speed independent of the impeller. The resulting ability of the flexible ring to float within the circular channel, and to minimize gaps, under these conditions has the advantage of restricting recirculation of fluid between the rotating and non-rotating elements of the pump, and also restricts the passage of abrasive material through the radial gap between the rotating and non-rotating elements to limit wear therebetween.

At all times during pump operation, a pressure differential exists on either side of the flexible ring, thereby acting against the outward radial deformation of the flexible ring within the circular channel. Such pressure differential and the ability of the ring to deform radially can be effectively moderated by the presence of expelling or pump out vanes installed on the impeller shroud facing inwardly toward the radial gap and positioned radially outward from the flexible floating ring placement. In addition, selection of the material properties of the ring will affect this radial deformation.

The particular placement of the flexible floating ring arrangement in a radially-extending axial gap between the rotating and non-rotating elements of the pump provides a more effective restriction of fluid recirculation and wear than is effected with sealing arrangements that are positioned in an axially-extending radial gap between rotating and non-rotating pump elements.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
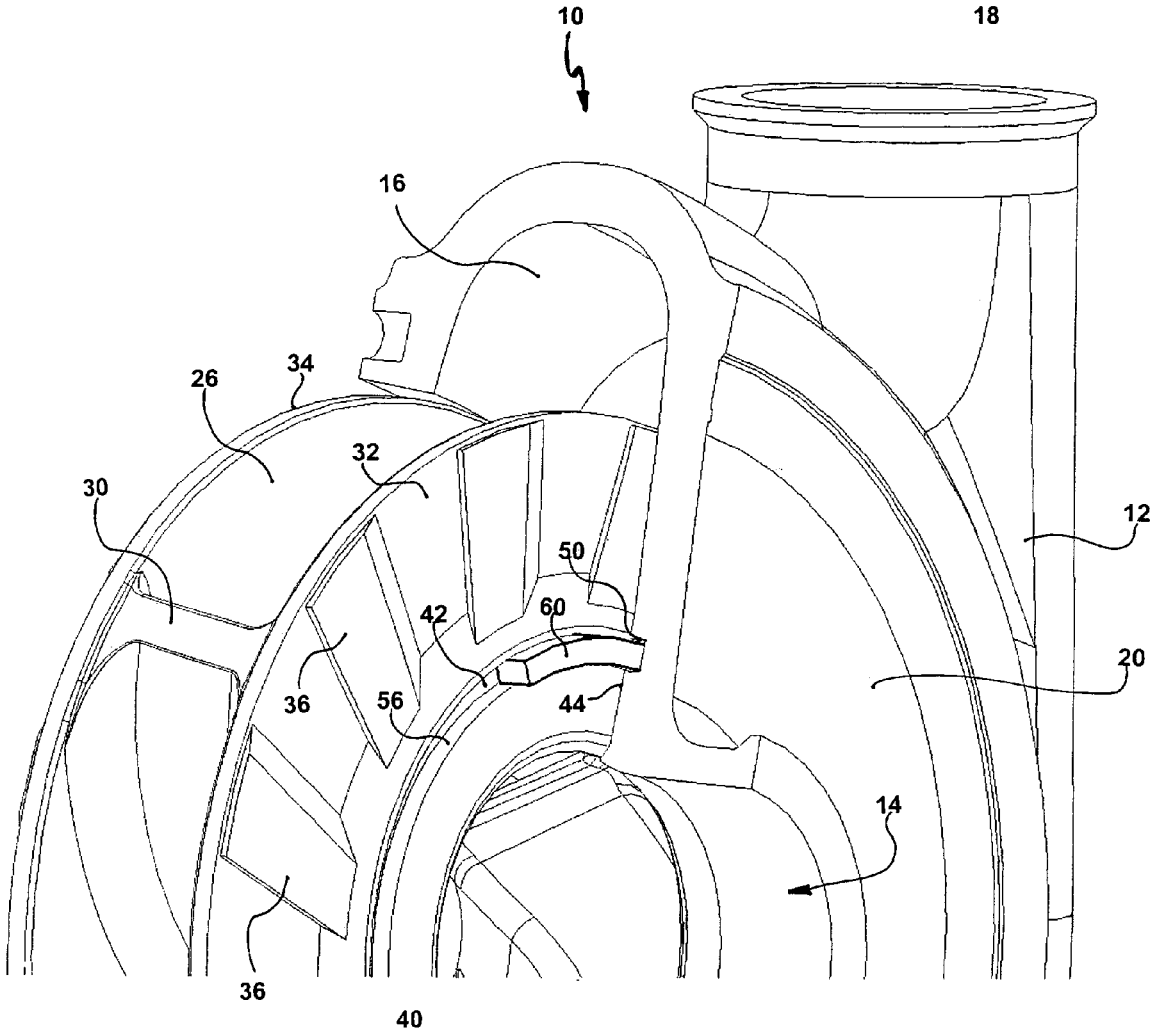
FIG. 1 is a perspective view of a portion of a rotodynamic pump illustrating the positioning of the floating ring seal arrangement of the present invention.
Figure 2:
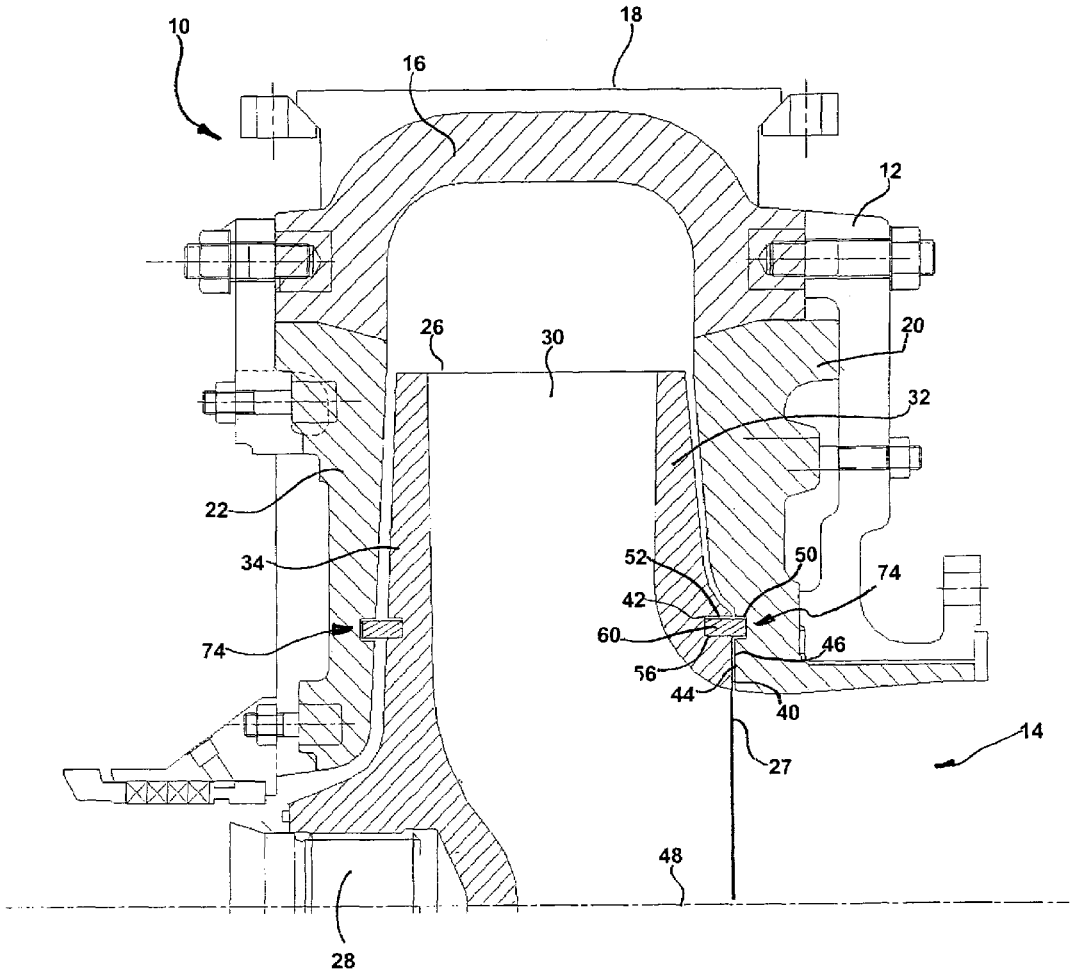
FIG. 2 is a view in cross section of a portion of a pump further illustrating the positioning of the floating ring seal arrangement of the present invention.

FIGS. 1 and 2 illustrate a portion of a rotodynamic pump 10 generally comprising a pump casing 12. The illustrated pump casing 12 is generally structured with an axially positioned fluid inlet 14, a volute section 16 and a tangentially-extending fluid outlet or discharge 18. In the particular pump casing 12 configuration that is illustrated in FIG. 1, the pump casing 12 is further structured with an integral suction side liner 20 and an integral drive side liner 22 (not viewable in FIG. 1). Alternatively, the pump casing 12 may be formed with a separate suction side liner 20 and separate drive side liner 22 as shown in FIG. 2.

The illustrated pump is of a centrifugal slurry type. However, the configuration of the rotodynamic pump 10 illustrated in FIGS. 1 and 2 is by way of example only and the floating ring seal arrangement of the present invention is not limited to use in the type of pump illustrated.

The pump 10 is further comprised of an impeller 26 that rotates within the pump casing 12. As best seen in FIG. 2, the impeller 26 is connected to a drive shaft 28 that extends through the pump casing 12 and rotates the impeller 26. The impeller 26 is configured with at least one vane 30 that extends radially outwardly from at or near the eye 27 (FIG. 2) of the impeller 26. The configuration of the impeller 26 may vary considerably. However, by way of example only, the illustrated impeller 26 is further configured with a front shroud 32 and a back shroud 34. As best seen in FIG. 1, the front shroud 32 may be structured with one or more expelling vanes 36, but the impeller may also be structured without expelling vanes.

In the present invention, the impeller 26 is formed with a radially-extending surface 40. An axially-extending groove 42 is formed in the surface 40 of the impeller 26. Likewise, the pump casing 12, and specifically the suction side liner 20 here illustrated, is formed with a radially-extending surface 44 which is opposite to and spaced from the radially-extending surface 40 of the impeller 26. An axial gap 46, as best seen in FIG. 2, is thereby formed between the two opposing surfaces 40, 44 and extends in a radial direction away from the rotational axis 48 of the impeller 26.

The radially-extending surface 44 of the pump casing 12 is likewise formed with an axially-extending groove 50 that is generally aligned with the groove 42 formed in the radial surface 40 of the impeller 26. The generally aligned grooves 42, 50 thereby form a circular channel 52 (FIG. 2) that spans the axial gap 46 between the rotating impeller 26 and stationary pump casing 12. In particular, the groove 42 of the impeller 26 is formed with an inner diameter 56, as best seen in FIG. 1.

A ring 60 is sized to be received by and is positioned within the circular channel 52 formed by the two grooves 42, 50. The ring 60 is sized in axial length to fit within the circular channel 52 formed by the two grooves 42, 50, and the ring 60 spans the radially-extending axial gap 46 between the rotating impeller 26 and non-rotating pump casing 12.

Figure 3:
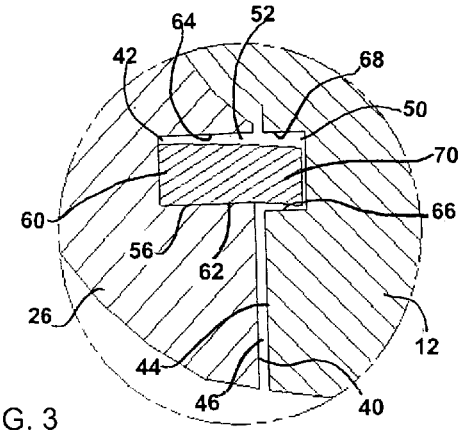
FIG. 3 is an enlarged view of the circular channel illustrating the floating ring employing a more elastic ring, and where the rotating element is static.

FIG. 3 provides an enlarged illustration of the ring 60 positioned within the circular channel 52 and illustrates some of the additional features of the present invention. It should first be noted that FIGS. 3 and 4 particularly illustrate the floating ring seal arrangement of the present invention when the impeller 26 is static, or not rotating. When the impeller 26 is not rotating, it can be seen that the flexible ring 60 is sized such that the inner diameter 62 of the flexible ring 60 contacts the inner diameter 56 of the groove 42 of the impeller 26.

Figure 4:
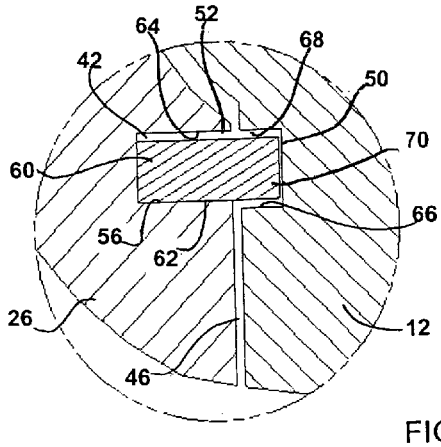
FIG. 4 is an enlarged view of the circular channel illustrating the floating ring seal arrangement where the ring is made of less elastic material, and the rotating element is static.

FIGS. 3 and 4 further illustrate the principle that the radial width of the groove 42 in the impeller 26 may be differently sized from the radial width of the groove 50 in the pump casing 12. That is, the radial width of the groove 42 is defined by the radial distance between the inner diameter 56 and outer diameter 64 of the groove 42. Likewise, the radial width of the groove 50 in the pump casing 12 is defined by the radial distance between the inner diameter 66 and outer diameter 68 of the groove 50.

As seen in FIG. 3, the radial width of the groove 50 in the pump casing 12 may be wider than the radial width of the groove 42 in the impeller 26. Seals, in general, will accommodate radial misalignment of the rotating and non-rotating elements of a pump. The potential misalignments of respective grooves 42, 50 in the impeller 26 and pump casing 12 may best be accommodated in the present invention by forming a groove 50 in the pump casing 12 that has a wider radial width, as shown in FIGS. 3 and 4. Ideally, the groove 42 in the impeller 26 and the groove 50 in the pump casing 12 will be generally aligned such that the outer diameter 64 of groove 42 will be equal to or slightly less than the outer diameter 68 of groove 50, and the inner diameter 56 of groove 42 will be slightly smaller than the inner diameter 66 of groove 50.

Figure 5:
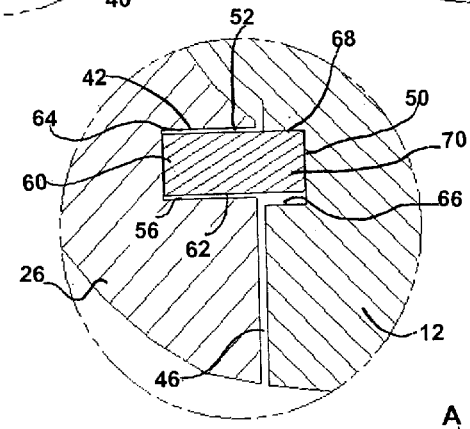
FIG. 5 is an enlarged view of the circular channel further illustrating the floating ring seal arrangement in an alternative embodiment of the circular channel.

However, as further seen in FIG. 5, the grooves 42, 50 may be respectively sized such that the outer diameter 68 of the groove 50 in the pump casing 12 is slightly less than the outer diameter 64 of groove 42 (i.e., as determined by a comparative measurement from the central axis 48 of the pump). In such a configuration as that shown in FIG. 5, the flexible ring 60 may, from time to time, contact the outer diameter 68 of the groove 50 as described more fully below.

FIGS. 3 and 4 also illustrate alternative embodiments of the flexible ring 60 where materials of different elasticity are employed in the flexible ring 60. Specifically, FIG. 4 illustrates a flexible ring 60 that is made of a less elastic material such that, at assembly of pump and the flexible floating seal ring assembly, the inner diameter 62 of the flexible ring 60 will be in contact with the inner diameter 56 of the groove 42 in the impeller 26, but that portion 70 of the flexible ring 60 which resides in the groove 50 in the pump casing 12 will not touch either the inner diameter 66 or outer diameter 68 of the groove 50.

Alternatively, as shown in FIG. 3, the flexible ring 60 may be made of a more elastic material such that when the impeller 26 is static, the inner diameter 62 of that portion 70 of the flexible ring 60 that resides in the groove 50 in the pump casing 12 droops slightly radially downwardly toward the inner diameter 66, but does not contact the inner diameter 66 of the groove 50. It may be noted that FIG. 4 is also representational of the relative positioning of the more elastic ring 60 shown in FIG. 3 when the rotation of the impeller 26 is such that the inner diameter 62 of the flexible ring 60 is still in contact with the inner diameter 56 of groove 42, but sufficient centrifugal force is exerted on that portion 70 of the flexible ring 60 which resides in the groove 50 that the portion 70 begins to deform radially outward.

The flexible ring 60 of the present invention is made of elastic material that enables the ring 60 to deform radially outwardly under centrifugal forces applied to the ring 60 by rotation of the impeller 26. The ring 60 is conversely able to contract radially inwardly again so that the inner diameter 62 of the flexible ring 60 comes into contact with the inner diameter 56 of the groove 42 when the impeller 26 ceases to rotate or when the rotation of the impeller 26 is not sufficient to maintain the radial expansion of the ring 60. The ring 60 may be made of any suitable material that provides the radial deformation capabilities as described. Some exemplar materials include, but are not limited to, low friction polymers.

Figure 6:
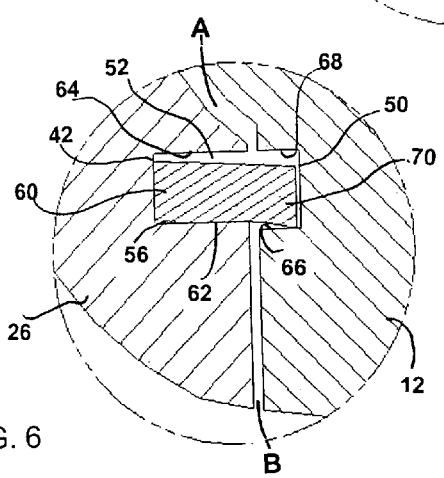
FIG. 6 is an enlarged view of the circular channel illustrating the position of the ring when the rotating element rotates at a speed such that the pressure forces dominate over centrifugal forces.

FIG. 6 illustrates the initial positioning of the flexible ring 60 when the impeller 26 is rotating. That is, when the impeller 26 begins to rotate at a slower speed, the flexible ring 60 begins to rotate with the impeller 26 as a consequence of the fact that the inner diameter 62 of the flexible ring 60 is in contact with the inner diameter 56 of the groove 42, as previously described. At this point, the forces due to pressure differential acting on the flexible ring 60 dominate over the centrifugal forces exerted on the ring 60 due to rotation, which may cause the flexible ring 60 to contact the inner diameter 66 of the groove 50 in the pump casing 12.

Figure 7:
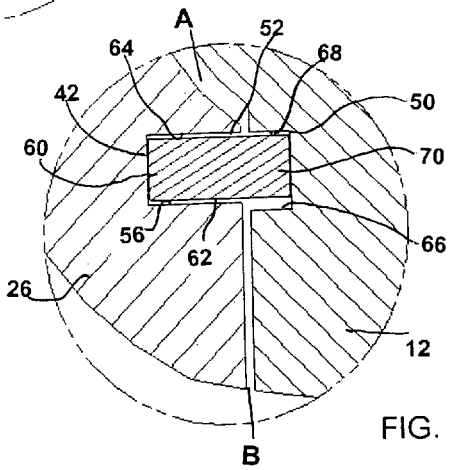
FIG. 7 is an enlarged view of the circular channel illustrating the floating ring seal arrangement when the rotating element is in rotation with a speed sufficient to allow the centrifugal forces to balance the action of pressure forces, thereby allowing the flexible ring to float.

As the rotation speed of the impeller 26 increases, centrifugal forces acting on the flexible ring 60 cause it to deform radially outwardly so that the inner diameter 62 of the ring 60 no longer contacts either the inner diameter 56 of groove 42 in the impeller 26 or the inner diameter 66 of the groove 50 in the pump casing 12. At that point, the ring 60 is floating in the circular channel 52, as illustrated in FIG. 7.

When the impeller 26 is rotating during operation of the pump, a pressure differential is created such that high pressure exists on side A of flexible ring 60 and low pressure exists on side B of the flexible ring 60. The high pressure exerted on the ring 60 from side A of the ring is counterbalanced by the centrifugal forces exerted on the flexible ring 60, and the flexible ring 60 is consequently maintained in a state of flotation within the circular channel 52, as illustrated in FIG. 7. Flotation of the flexible ring 60 in the circular channel 52 reduces surface friction between the flexible ring 60 and the inner walls of the circular channel 52.

As the flexible ring 60 begins to float in the circular channel 52, centrifugal forces on the flexible ring 60 decrease and the flexible ring 60 will begin to deform radially inwardly again with a consequent contact between the inner diameter 62 of the flexible ring 60 and the inner diameter 56 of the groove 42 of the impeller 26. When such contact is made between the flexible ring 60 and the groove 42, the centrifugal forces again act upon the flexible ring 60 to cause it to float within the circular channel 52. Thus, the flexible ring 60 will fluctuate between a first state of floating in the circular channel 52 free of the impeller 26 and a second state of contacting the impeller 26 as described. These fluctuating states are also influenced by the rotational speed of the impeller 26.

The differential pressures between side A and side B of the flexible ring 60 further influence the position of the flexible ring 60 in the circular channel 52 at any given time. As shown in FIG. 6, for example, when the pressure forces on side A dominate over the centrifugal forces exerted on the flexible ring 60, the flexible ring 60 may be forced into contact with the inner diameter 56 of groove 42 and that portion 70 of the flexible ring 60 that resides in the groove 50 of the pump casing 12 may come into contact with the inner diameter 66 of the groove 50. Again, FIG. 7 illustrates a situation where the pressure forces on side A of the flexible ring 60 are counterbalanced with the centrifugal forces exerted on the flexible ring 60.

It may also be noted that the differential pressures that are exerted on the flexible ring 60 are influenced by the existence of expelling vanes positioned along the radial surface of the impeller shroud, and the configuration and/or dimension of those expelling vanes. That is, the existence of expelling vanes in general tends to decrease the pressure forces exerted on side A of the flexible ring 60. Also, the radial length dimension of the expelling vanes will influence the pressure forces, and thereby influence the radial deformation of the flexible ring 60.

The ring 60 bridging the axial gap 46 increases the hydraulic resistance of the axial gap 46 to fluid recirculation between the rotating impeller 26 and the stationary pump casing 12. Consequently, the resistance of fluid recirculation also increases the resistance to abrasive particulates in the fluid from infiltrating between the rotating and non-rotating elements of the pump, thereby reducing wear therebetween. Further, the ability of the ring 60 to float in the circular channel 52 reduces mechanical losses due to friction, and reduces wear in the ring 60 itself as a result of reduced rotational velocity.

The ring 60 of the floating ring seal arrangement is shown in FIGS. 1-5 as having essentially a rectangular cross section. However, the ring 60 may be structured with a different cross sectional geometry from that illustrated. The ring 60 may be made by any well-known and suitable means, such as molding. Likewise, the grooves 42, 50 respectively formed in the rotating and non-rotating elements of the pump may be formed by any suitable means, such as molding or machining. It can further be appreciated that the simplicity of the circular channel 52 and flexible ring 60 arrangement greatly facilitate assembly of the floating ring seal arrangement during assembly of the pump.

As further shown in FIG. 2, the flexible floating ring assembly 74 of the present invention may be employed in connection with the suction side liner 20 of the pump casing 12, as heretofore described, and may be employed in the drive side liner 22 as well to provide resistance to fluid recirculation and wear between the drive side liner 22 and the impeller 26.

The flexible floating ring seal arrangement of the present invention is particularly directed to use in rotodynamic pumps of the type which are used to process slurries. However, those of skill in the art will appreciate the advantages provided by the flexible floating ring seal arrangement of the present invention and will appreciate that the invention may be adapted for use in a variety of types of rotodynamic pumps. Hence, reference herein to specific details or embodiments of the invention are by way of illustration only and not by way of limitation.

What is claimed is:

1. A floating ring seal arrangement for rotodynamic pumps, comprising:

a non-rotating element of a rotodynamic pump having a radially-extending surface and a groove formed in said radially-extending surface of said non-rotating element;

a rotating element of the pump having a radially-extending surface and a groove formed in said radially-extending surface of said rotating element which is in general alignment with said groove formed in said non-rotating element to thereby form a circular channel; and a flexible ring sized to fit in said circular channel, said flexible ring being radially deformable to intermittently float within said circular channel when the pump is in operation.

2. The floating ring seal arrangement of claim 1 wherein said groove of said rotating element has an inner diameter and wherein said flexible ring has an inner diameter which is slightly less than said inner diameter of said groove such that when said impeller is not rotating, said flexible ring is in contact with said inner diameter of said groove.

3. The floating ring seal arrangement of claim 2 wherein said flexible ring is made of a low friction polymer.

4. The floating ring seal arrangement of claim 1 wherein said groove of said rotating element has a radial width and said groove of said non-rotating element has a radial width which is greater than said radial width of said groove of said rotating element.

5. The floating ring seal arrangement of claim 1 wherein said non-rotating element is the pump casing of the pump.

6. The floating ring seal arrangement of claim 5 wherein said pump casing is the suction side liner of the pump.

7. The floating ring seal arrangement of claim 5 wherein said pump casing is the drive side liner of the pump.

8. The floating ring seal arrangement of claim 5 wherein said rotating element is an impeller.

9. A floating ring seal arrangement for rotodynamic pumps, comprising:

a stationary element of a pump having a radially-extending surface;

a rotating element of the pump having a radially-extending surface opposite to and axially spaced from said radially-extending surface of said stationary element to form an axial gap therebetween;

a groove formed in said radially-extending surface of said stationary element and a groove formed in said radially-extending surface of said rotating element generally aligned with said groove formed in said stationary element to thereby provide a circular channel spanning said axial gap;

a flexible, radially deformable ring positioned within said circular channel and sized to span said axial gap.

10. The floating ring seal arrangement of claim 9 wherein said circular channel has an inner diameter defined at least in part by said groove in said rotating element, and wherein said flexible ring has an inner diameter that is slightly less than said inner diameter of said groove to provide a snug fit of said flexible ring on said inner diameter of said rotating element when said rotating element is not rotating.

11. The floating ring seal arrangement of claim 9 wherein said flexible ring is radially deformable under centrifugal force.

12. The floating ring seal arrangement of claim 11 wherein said flexible ring is further sufficiently radially flexible to deform radially inwardly within said groove formed in said non-rotating element under forces of pressure.

13. The floating ring seal arrangement of claim 9 wherein said rotating element is an impeller.

14. The floating ring seal arrangement of claim 9 wherein said stationary element is a portion of the pump casing of a pump.

15. The floating ring seal arrangement of claim 9 wherein said flexible ring is positioned on the suction side of the pump.

16. The floating ring seal arrangement of claim 9 wherein said pump casing is the drive side liner of the pump.

17. The floating ring seal arrangement of claim 9 wherein said groove formed in said stationary element and said groove formed in said rotating element each have a radial width, said radial width of said groove in said stationary element being equal to or greater than said radial width of said groove in said rotating element.

* * * * *